US007143571B2

(12) United States Patent
Rosenwasser et al.

(10) Patent No.: US 7,143,571 B2
(45) Date of Patent: Dec. 5, 2006

(54) METHOD OF FORMING CHAIN LINKS

(75) Inventors: David Rosenwasser, Englewood Cliffs, NJ (US); Avraham Moshe Rosenwasser, Englewood Cliffs, NJ (US)

(73) Assignee: Moshe Avraham Rosenwasser, Norwood, NJ (US)

( * ) Notice: Subject to any disclaimer, the term of this patent is extended or adjusted under 35 U.S.C. 154(b) by 0 days.

(21) Appl. No.: 11/200,440

(22) Filed: Aug. 9, 2005

(65) Prior Publication Data

US 2005/0268592 A1 Dec. 8, 2005

Related U.S. Application Data

(63) Continuation of application No. 10/107,994, filed on Mar. 27, 2002, now Pat. No. 6,993,896, which is a continuation-in-part of application No. 09/473,594, filed on Dec. 29, 1999, now Pat. No. 6,389,790.

(51) Int. Cl.
*B21L 7/00* (2006.01)
*B21L 12/00* (2006.01)
*B21F 3/04* (2006.01)

(52) U.S. Cl. ..... 59/35.1; 59/20; 59/80; 59/82; D11/13

(58) Field of Classification Search ..... 59/20, 59/35.1, 80, 82, 93
See application file for complete search history.

(56) References Cited

U.S. PATENT DOCUMENTS 4,275,555 A 6/1981 Bichi
4,679,391 A 7/1987 Tizzi
5,129,220 A 7/1992 Strobel
D329,828 S 9/1992 Bedoyan
D337,073 S 7/1993 Bedoyan
5,285,625 A 2/1994 Ofrat et al.
5,303,540 A 4/1994 Rozenwasser
5,309,704 A 5/1994 Grando
5,353,584 A 10/1994 Strobel et al.
5,412,935 A 5/1995 Rozenwasser
5,471,830 A 12/1995 Gonzales
D368,048 S 3/1996 Rozenwasser
D370,184 S 5/1996 Rozenwasser
D370,426 S 6/1996 Rozenwasser
5,526,639 A 6/1996 Gonzales
5,531,065 A 7/1996 Rozenwasser
5,537,812 A 7/1996 Rozenwasser
5,544,477 A 8/1996 Rozenwasser
D376,119 S 12/1996 Rozenwasser
5,737,910 A 4/1998 Rozenwasser
5,797,258 A 8/1998 Strobel et al.
6,209,306 B1 4/2001 Chia et al.
6,223,516 B1 5/2001 Falcon et al.
6,389,790 B1 5/2002 Rosenwasser et al.
6,484,488 B1 11/2002 Rosenwasser et al.

*Primary Examiner*—David Jones
(74) *Attorney, Agent, or Firm*—Katten Muchin Rosenman LLP

(57) ABSTRACT

Several methods of forming links for use with the creation of rope chains is disclosed, whereby the outer peripheries of such links are contoured prior to assembly into rope chains. In one embodiment, the wire used in the formation of intertwinable links is contoured and then cut into individual, pre-contoured links. In another embodiment, the outer periphery of non-contoured links are individually contoured prior to the intertwining of such links to form actual rope chains. In another embodiment, individual links are collectively contoured, preferably after arrangement on a support such as a mandril. Such contouring can be accomplished by hand, machine or the like.

10 Claims, 11 Drawing Sheets

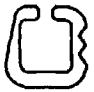
FIG. 14p
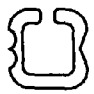
FIG. 14q
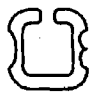
FIG. 14r
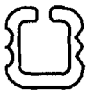
FIG. 14s
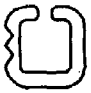
FIG. 14t
FIG. 14u
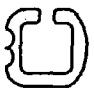
FIG. 14v
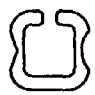
FIG. 14w
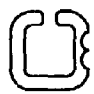
FIG. 14x
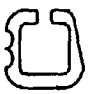
FIG. 14y
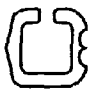
FIG. 14z
FIG. 14aa
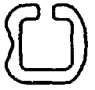
FIG. 14ab
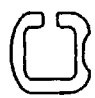
FIG. 14ac
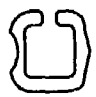
FIG. 14ad
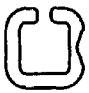
FIG. 14ae
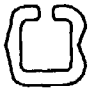
FIG. 14af
FIG. 14ag
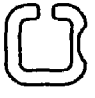
FIG. 14ah
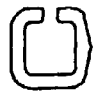
FIG. 14ai
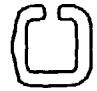
FIG. 14aj
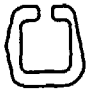
FIG. 14ak
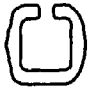
FIG. 14al
FIG. 14am

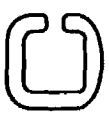
FIG. 14bl
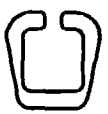
FIG. 14bm
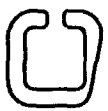
FIG. 14bn
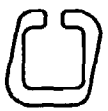
FIG. 14bo
FIG. 14bp

METHOD OF FORMING CHAIN LINKS

CROSS-REFERENCE TO RELATED APPLICATIONS

This application is a continuation of U.S. application Ser. No. 10/107,994 filed Mar. 27, 2002, now U.S. Pat. No. 6,993,896, which is a continuation-in-part of U.S. application Ser. No. 09/473,594 filed Dec. 29, 1999, now U.S. Pat. No. 6,389,790.

FIELD OF THE INVENTION

This invention relates to a method of forming chain links for use in making fine jewelry rope chains, and more specifically, to method of contouring the outer periphery of individual links.

BACKGROUND OF THE INVENTION

A fine jewelry "rope" chain is usually comprised of individual links intertwined to form a chain having the appearance of a double helix. The intertwining of such links is customarily done by hand, with gaps facilitating the interengagement or intertwining of links to form a chain. The rope chain art has evolved considerably since its inception, to the extent that a layman probably takes for granted the complicated and various methods used to create a highly decorative and ornamental piece of jewelry.

The appearance of individual links and the manner in which such links are intertwined to form a chain usually dictate the appearance of the resultant chain. The prior art is replete with rope chains formed from solid and hollow links having all different shapes and sizes. Such links are also formed using a variety of methods. Conventionally, a solid or hollow wire is wrapped around a supporting core and then cut so that the wire separates into individual pieces, each piece having a gap for intertwining with other pieces (the term "wire" is customarily used in the jewelry rope chain art and will be used herein to designate a solid strand of material, or a flat, stamped material that has been rolled into an elongated strand of tubular cross-section). After the wire is cut, and before the individual pieces can be intertwined, the pieces are straightened into links. Other methods of creating links are known in the art, including punching an individual link from a sheet of material using a one-step process as taught by Rozenwasser in U.S. Pat. No. 5,544,477 or a two-step process as taught by Grando in U.S. Pat. No. 5,309,704.

Recently, there has been a movement in the rope chain field toward highly decorative surface ornamentation, where the outer surface or periphery of individual chain links are modified or materially altered, both before and after they have been formed into a rope chain. Surface ornamentation usually occurs after the links have been assembled into a rope chain, through methods widely known in the art. This usually involves the creation of a rope chain, followed by the faceting, notching, cutting, bending, deforming, scraping or the like, of distinct portions of such chain, until the desired surface effect is achieved on exposed portions of individual links and the chain as a whole.

Certain methods of surface ornamentation are dependent or preferred based on the type of link used to form the chain, while other methods are preferred depending on the desired effect one wishes to achieve. For example, U.S. Pat. No. 5,129,220 to Strobel and U.S. Pat. No. 5,353,584 to Strobel et al., disclose the incremental deforming, by a blunt, burnishing tool, of a hollow link rope chain, which results in individual links having flattened exposed surfaces. U.S. Pat. No. 5,285,625 to Ofrat et al. discloses the use of a diamond cut forming machine to create diamond cut facets extending spirally around the longitudinal center of the chain, while U.S. Pat. No. 5,303,540 to Rozenwasser discloses the use of a diamond-cutting edge to create shallow depressions along the surface of a thin plate of metal that will eventually be formed into a wire and then a link. The Rozenwasser '540 patent also discloses the creation of shallow depressions on a wire prior to dividing or cutting into links, while U.S. Pat. No. 5,412,935, also to Rozenwasser, discloses the cutting of facets into a link having a raised surface. See also U.S. Pat. No. 5,537,812 to Rozenwasser. U.S. Pat. Nos. 5,471,830 and 5,526,639 to Gonzales disclose the cutting of an assembled rope chain to create a continuously curved surface.

In addition to providing surface ornamentation in the form of faceting and contouring, the overall appearance of rope chains has in the past been altered by using links of various shapes. For example in U.S. Design Pat. Nos. 368,048 and 370,184 and 370,426 all to Rozenwasser, modified "C"-shaped links are intertwined to form jewelry rope chains having unique overall designs. While the design of each link is ornamentally unique, each link has a consistent inner and outer peripheral surface and profile and a consistent thickness along such profile.

The faceting and contouring of assembled rope chains has become fairly complicated to meet the demands for unique surface configurations. This has resulted in contouring methods and machinery of increased complexity. There exists a need, therefore, for a method of creating fashionably contoured jewelry chains and jewelry rope chains that is relatively uncomplicated, efficient to implement, inexpensive in its operation, and provides the designer with a multitude of contouring options unseen or unexperienced in the prior art. Recognizing this need, the present inventor has devised a method of creating ornamentally desirable jewelry chains and jewelry rope chains by fashionably contouring the outer periphery of individual links, thereby avoiding the costly process of enlisting complicated machinery to act upon ever-increasingly complicated rope chain configurations. More specifically, one embodiment of the method of the present invention involves the arrangement of individual links onto a mandril, followed by the contouring of the outer periphery of such links by hand, machine or the like. After the individual links have been contoured as desired, the links are removed from such mandril and assembled into rope chains using methods known in the art. In other embodiments, the outer peripheries of individual links are contoured without the use of a mandril.

OBJECTS OF THE INVENTION

It is an object of the present invention, therefore, to provide a method of creating fashionably contoured jewelry chains and jewelry rope chains that is relatively uncomplicated, efficient to implement, inexpensive in its operation, and provides the designer with a multitude of contouring options.

It is a further object of the present invention to provide a method of creating fashionably contoured jewelry chains and jewelry rope chains by contouring the outer periphery of individual chain links prior to assembly into chains.

It is a still further object of the present invention to provide a method of creating fashionably contoured jewelry chains and jewelry rope chains by contouring the outer periphery of a coiled wire prior to separation into individual links and assembly of such links into chains.

It is a still further object of the present invention to provide a method of creating fashionably contoured chains by arranging individual chain links onto a mandril prior to contouring the outer periphery of such links.

It is a still further object of the present invention to provide a method of creating fashionably contoured jewelry chains by arranging individual chain links onto a mandril and contouring the outer periphery of such links along one or a variety of locations along such outer periphery.

It is a still further object of the present invention to provide a method of forming chain links by contouring the outer peripheries of such links, whether created from a wire, a punching process or the like, while arranged on a mandril.

It is a still further object of the present invention to provide a method of forming chain links by contouring the outer peripheries of such links by hand, machine or the like.

It is a still further object of the present invention to provide a method of forming chain links having inner and outer peripheries of different shapes.

It is a still further object of the present invention to provide a method of forming chain links having a non-uniform thickness.

Still other objects and advantages of the invention will become clear upon review of the following detailed description in conjunction with the appended drawings.

SUMMARY OF THE INVENTION

Individual chain links used in forming jewelry rope chains are provided, being formed from solid or hollow wire, punched or the like, and being produced using methods known in the art. The outer peripheries of such links are contoured prior to assembly into jewelry chains and jewelry rope chains. In one embodiment, the outer periphery of links are contoured during the creation of the link or while the link material is still in the form of a wire. In another embodiment, non-contoured links are arranged on a mandril, and the outer peripheries of such links are then contoured or deformed as desired. Contouring of the outer periphery can be accomplished by hand, machine or the like, using a variety of methods. Prior to contouring of the outer periphery, the individual chain links or material made therefrom may or may not have a gap for intertwining with other links to form a jewelry chain. If individually created links are not provided with a gap, i.e., if the links have continuous inner and outer peripheries, then a gap can be formed into such links as part of the contouring step. The outer peripheries of wire or links used in the formation of jewelry chains and jewelry rope chains may be contoured using a single stroke or pass by a contouring mechanism, or several passes, until the desired contouring is achieved. Multiple contours can also be applied by a single pass of a contouring apparatus having multiple deformation means.

BRIEF DESCRIPTION OF THE DRAWINGS

FIG. 5 is a diagrammatic view of a stamping method of forming chain links having contoured outer peripheries for assembly into rope chains and the like.

DETAILED DESCRIPTION OF THE PREFERRED EMBODIMENTS

Rope chain links are usually contoured after the links are formed into chains by passing such chains through contouring implements, such as cutters, presses and the like. Solid links are conventionally contoured or faceted by cutting, while hollow links are conventionally contoured or faceted by pressing or stamping.

In accordance with one of the methods of the present invention, contouring of the outer periphery of chain links occurs prior to assembly of such links into jewelry chains and/or jewelry rope chains. In one embodiment, the wire used in the formation of intertwinable links is contoured and then cut into individual, pre-contoured links. In another embodiment, the outer periphery of non-contoured links are individually contoured prior to the intertwining of such links to form actual jewelry chains. In yet another embodiment, individual links are collectively contoured after they are arranged on a supporting structure, such as a mandril. Such links may be contoured by hand or machine as the case may be. It will be understood that chain links or links of any size, shape, thickness, material and cross-section may be used, for the method of the present invention is not meant to be limited to any particular link configuration. Therefore, while certain link cross-sections are shown for purposes of illustrations, whether they be annular or rectangular, it will be understood that the overall shape of the link could also be oval, triangular, square or the like.

In accordance with another aspect of the method of the present invention, non-intertwinable links, i.e., rings or links initially without gaps for intertwining to form rope chains, may be arranged on a supporting mandril, with the gaps formed into such links as part of the contouring process. In other words, as the outer peripheries of the links are being contoured, a gap will be cut between the inner and outer peripheries of such links for intertwining with other links to form rope chains. Consequently, the contouring and the gap creation can be accomplished during a single manufacturing process, which reduces costs, improves efficiency and prevents the creation of a link initially provided with a gap, which can be a complexity when links are formed by stamping or punching.

The following detailed description is of the best mode or modes of the invention presently contemplated. Such description is not intended to be understood in a limiting sense, but to be an example of the invention presented solely for illustration thereof, and by reference to which in connection with the following description and the accompanying drawings one skilled in the art may be advised of the advantages and construction of the invention.

Figure 1:
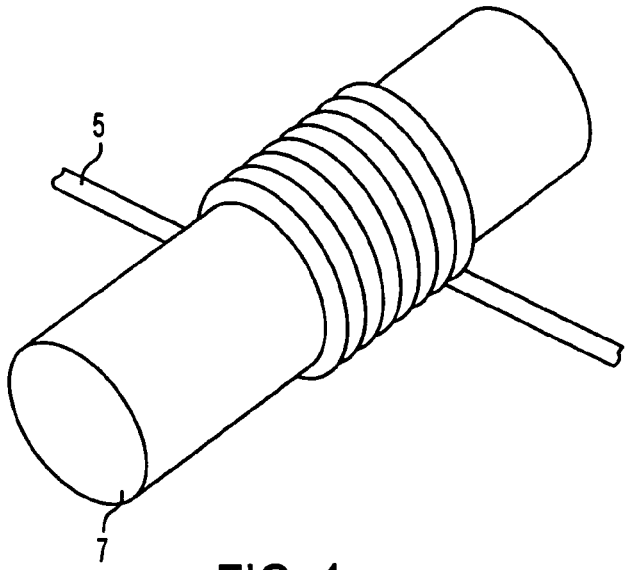
FIG. 1 (PRIOR ART)
FIG. 1 is an isometric view of a wire wound around a support illustrating a prior art method of forming links for the assembly of rope chains.

Intertwinable links used in the formation of jewelry rope chains are usually created using one of two well known methods. FIG. 1 illustrates one method that is well known in the art, where a solid or hollow wire 5 is first coiled around a support structure 7 and then a portion of such wire is sliced along the longitudinal axis of the support structure 7 to form individual wire segments, which segments are then flattened into intertwinable links. Another well known method of forming links is by stamping or punching, an example of which is shown in U.S. Pat. No. 5,544,477 to Rozenwasser.

Figure 2:
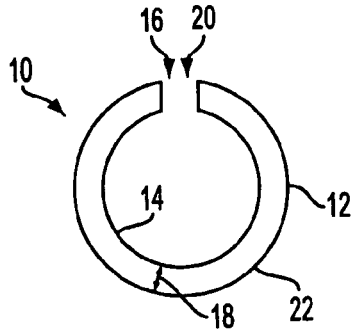
FIG. 2 (PRIOR ART)
FIG. 2 is a front view of a prior art link used in the assembly of rope chains.

FIG. 2 is a front view of a conventional link 10 used in the formation of rope chains, said link 10 having an outer periphery 12 of a predetermined shape, an inner periphery 14 of a predetermined shape, a gap 16 and a thickness 18. The outer periphery 12 of said link 10 is divided into a gap location 20 along which contouring is not useful, and a contouring surface 22 along which contouring is possible. Said link 10 may be formed from a solid or hollow wire 5 as is known in the art shown in FIG. 1, or may be formed by stamping or punching as is also known in the art. Other methods may also be used to form a link that is to be contoured in accordance with the methods of the present invention. Also, it will be understood that while wires and links of certain profiles and cross-sectional configurations are used herein for purposes of illustration herein, any shaped wire and any shaped link may be used.

The conventional link 10 of FIG. 2 used in the assembly of rope chains has certain noteworthy characteristics. First, the inner and outer peripheries 12 and 14 respectively have the same or similar shape. In FIG. 2, the link 10 has an annular configuration along its inner and outer periphery. Second, the thickness 18 of the link 10 is generally consistent from end to end. Contrary to convention, the links of the present invention, after they have been contoured in accordance with the teachings of the present invention, however, generally do not have consistent inner and outer peripheries, and generally do not have a consistent thickness throughout.

Figure 3:
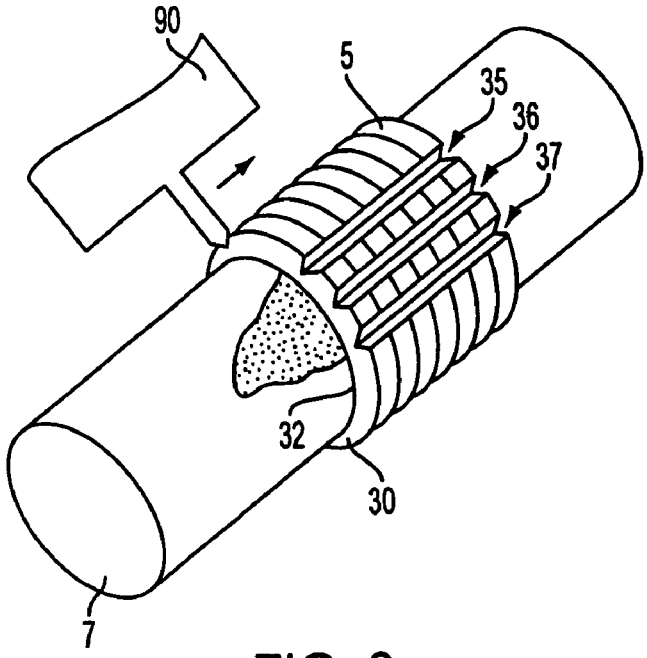
FIG. 3 is an isometric view of one method of forming chain links for assembly into rope chains, illustrating the contouring the outer periphery of a wire prior to segmenting into individual links.

In accordance with one method of the present invention of forming chain links for assembly into rope chains, as shown in FIG. 3, a contouring apparatus 90 is drawn across, or is passed across the outer periphery 30 of the wire 5 while the wire 5 is supported on a support structure 7. One such support structure 7 might be an ice lathe as shown and as taught in U.S. Pat. No. 5,737,910 to Rozenwasser. Similarly, the contouring apparatus could be stationary, and the wire 5 passed thereby. The outer periphery 30 of the wire 5 is contoured, while the inner periphery 32 remains unaffected, or retains its original shape. Once the outer periphery 30 of the wire has been contoured as desired, the wire is separated into segments and flattened into chain links.

Figure 4:
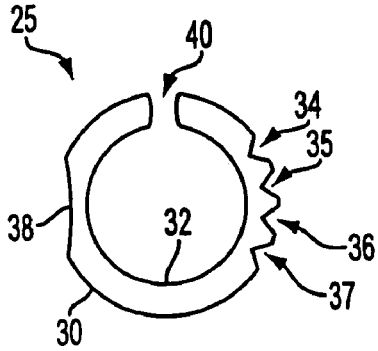
FIG. 4 is a front view of an individual link having a contoured outer periphery formed in accordance with a method of the present invention.

FIG. 4 is a front view of a link 25 produced in accordance with the method illustrated in FIG. 3. The link 25 has a plurality of grooves 34–38 along the outer periphery 30, a gap 40 and an inner periphery 32 that remains unaffected by the contouring apparatus 90. The gap 40 might be formed during the contouring operation by contouring the outer periphery 30 through to the inner periphery 32. The grooves 34–37 in FIG. 4 along one side of the outer periphery 30 have the same appearance, while the groove 38 along the other side has a different appearance. Consequently, the contouring operation does not have to be consistent along the entire outer periphery, although it could be if desired.

Figure 5:
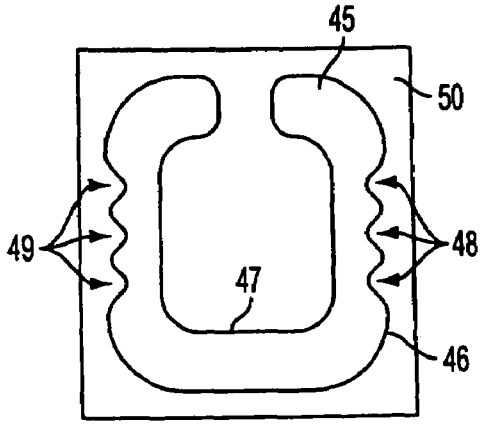

In accordance with another method of the present invention of forming chain links for assembly into rope chains, as shown in FIG. 5, a link 45 might be stamped or punched from a single sheet 50, with such link 45 having a contoured outer periphery 46 and an non-contoured inner periphery 47. The contouring can comprise a plurality of grooves 48,49 on opposite sides, which create a symmetrical appearance along the vertical axis through the center of the link. Several links 45, therefore, can be assembled into rope chains and other jewelry items that have inner and outer peripheries of different shapes or profiles. In accordance with yet another method of the present invention of forming chain links for assembly into rope chains, such links might also be die extruded or the like, having inner and outer peripheries of different shapes or profiles.

Figure 6:
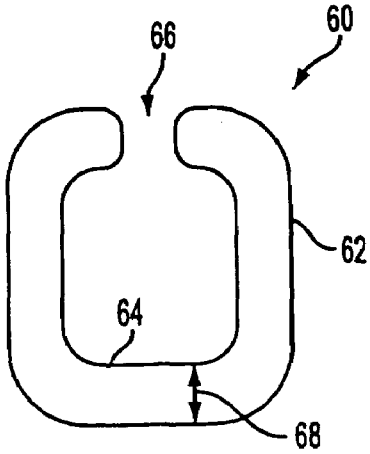
FIG. 6 is a front view of a link that will be contoured in accordance with one method of the present invention.

FIG. 6 is a front view of a link 60 used to illustrate another method of the present invention of forming chain links for assembly into rope chains. Link 60 has a non-contoured outer and inner periphery 62 and 64 respectively, a gap 66 and a thickness 68. In accordance with yet another method of the present invention of forming chain links for assembly into rope chains, the outer peripheries 62 of individual links 60 are contoured in unison by, for example, loading such links onto a mandril, which provides a support structure for group contouring.

Figure 7:
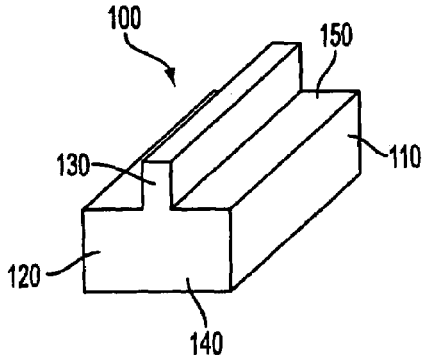
FIG. 7 is an isometric view of a mandril onto which links are arranged prior to contouring the outer peripheries of such links.

FIG. 7 is an isometric view of a mandril 100 having an outer periphery 110 of a predetermined shape, that, for purposes of explanation, has a cross-section generally in the form of an inverted "T", comprised of a primary support section 120 and an extended support section or protrusion 130. The mandril 100 also has a first end or edge 140 and a second end or edge 150, and may be rigid or flexible depending on the needs of the user. The mandril 100 is designed to support a single link 60 or a plurality of links slidably arranged thereon, for eventual passage of the link-loaded mandril through contouring apparatus.

Figure 8:
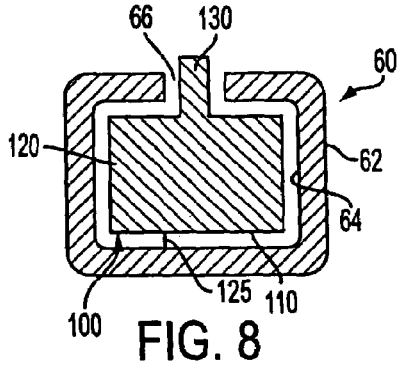
FIG. 8 is an edge view of a link arranged on a mandril.

FIG. 8 is an edge view illustration of link 60 situated about or arranged on a mandril 100, with the outer periphery 110 of mandril 100 designed to accommodate the inner periphery 64 of link 60, so that link 60 can slide along the outer periphery 110 of mandril 100. The support section 130 of mandril 100 extends or protrudes into the gap area 66 of the link 10, which section 130 further supports and centers the link 60 on the mandril 100. Again, while FIG. 8 illustrates for purposes of explanation a link having a generally rectangular inner periphery slidably arranged on a mandril having a generally rectangular outer periphery, it will be understood that both the mandril and the link may be designed using other shapes, so long as the link is capable of being suitably arranged along the outer periphery of the mandril and is supportably received thereon. The clearance 125 between the outer periphery 110 of the mandril 100 and the inner periphery 64 of the link 60 will generally be sufficient enough to permit arranging of the link 10 along the mandril, but not too great so that the link 60 wobbles or rocks from side to side on the mandril 100, or is rotatable on or around said mandril. In other words, movement of the link on or along the mandril is preferably restricted to the axial direction, i.e., along the axis of the mandril. It is not necessary, however, that the clearance 125 be the same between the link and the mandril on all sides of the mandril. Since a link-loaded mandril will be passed through contouring apparatus, such links should be sufficiently supported on the mandril so that such contouring of the outer periphery is consistent, and the clearance 125 between the mandril and the links arranged thereon, particularly adjacent the link section or sections being contoured, should not be great enough to frustrate the consistent contouring of the outer periphery of such links.

Figure 9:
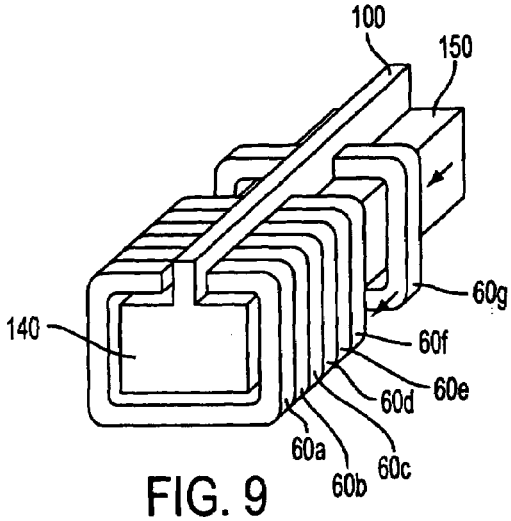
FIG. 9 is an isometric view of a plurality of links slidably arranged on a mandril.
Figure 10:
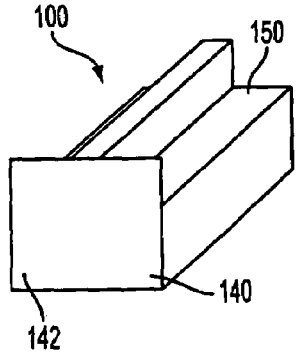
FIG. 10 is an isometric view of a mandril provided with a stopping means along one edge thereof.

FIG. 9 is an isometric view of a plurality of links 60*a*–60*g* slidably arranged on a mandril 100. The links will generally be loaded along an entrance end 150 or edge of the mandril, and slid or extended to the opposite end 140, where such links will be prevented from sliding off the mandril using a stopping means or member 142 (see FIG. 10) coupled to or disposed at the end 140 of the mandril 100 opposite the entrance end 150. The stopping member 142, illustrated in FIG. 10, could take the form of a pin, wall or the like, and an equivalent stopping member could also be disposed at the entrance end of the mandril after the links have been arranged thereon to prevent such links from sliding off the entrance end of the mandril. Once links are arranged on a mandril, a hand tool may be drawn across the outer peripheries of such links to contour such outer peripheries as desired. Such hand tool may be used to cut, score, bend or otherwise deform the outer peripheries of such links until the desired surface configuration is achieved. The contouring operation does not, however, effect the contouring of the inner peripheries of such links.

Figure 11:
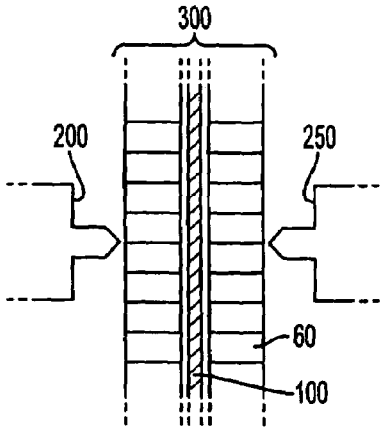
FIG. 11 is a top, diagrammatic view of a link-loaded mandril being passed through contouring apparatus.
Figure 12:
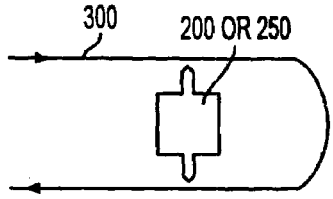
FIG. 12 is a top, diagrammatic view of a link-loaded mandril being passed on each side through a single contouring apparatus.

Hand contouring can be somewhat difficult, particularly if the metal is hard or the desired outer periphery contour is intricate. Conventional contouring is usually accomplished by diamond-cutting contouring apparatus or by punches, presses or the like. FIG. 11 is a top, diagrammatic view of a mandril 100 with a plurality of links 60, arranged thereon, defined collectively as a link-loaded mandril 300, being passed through contouring apparatus 200 and 250. Similarly, the contouring apparatus could movably act upon a link-loaded mandril for contouring of the links, and it is not necessary that the link-loaded mandril be the moveable part that travels through the contouring apparatus. Contouring apparatus 200 and 250 may be cutters, shapers or the like, and act upon any portion of the outer peripheries, and preferably the contouring surface and not the gap location, of the links that are passed therethrough. For example, while FIG. 11 illustrates the contouring of opposite sides of the links, it will be appreciated that the upper and lower portions of the outer peripheries of the links may also be contoured, depending on the design of the contouring apparatus and the section of the links passed therethrough. Furthermore, while a pair of contouring apparatus 200 and 250 is shown, only one contouring apparatus, 200 or 250 for example, may be necessary if only one side of the outer periphery of the links are to be contoured, or, as illustrated in FIG. 12, if opposite sides are to be contoured in an identical manner and a link-loaded mandril 300 can be passed through such contouring apparatus once along each side of the mandril.

Figure 13:
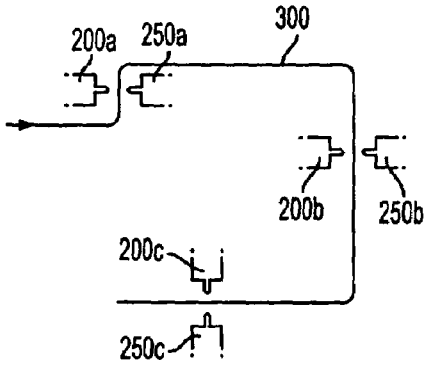
FIG. 13 is a top, diagrammatic view of a link-loaded mandril being passed through multiple contouring apparatus.

FIG. 13 is a top, diagrammatic view of a link-loaded mandril 300, showed representatively by a single line, being passed through three pairs or sets of contouring apparatus 200*a–c* and 250*a–c*. The first two pairs of contouring apparatus 200*a,b* and 250*a,b*, for example, might contour the sides of the outer peripheries of the links, while the third pair of contouring apparatus 200*c* and 250*c*, for example, might contour the upper and lower portions of the outer peripheries of the links. It will be appreciated, with particular reference to FIGS. 11 and 12, that the mandril upon which the links are loaded or arranged should preferably be flexible to allow a link-loaded mandril to pass through contouring apparatus if such passage occurs along a circuitous route. A flexible mandril also allows a link-loaded mandril to repeatedly pass through the same contouring apparatus so that different portions of the outer peripheries can be contoured, see FIG. 11, or to pass through different contouring apparatus arranged in a non-linear fashion as shown for example in FIG. 12.

While FIGS. 7–13 illustrate the use of a mandril for practicing the method of the present invention, other contouring apparatus may be used in a similar manner. For example, instead of using a mandril, groups of links might be arranged on an ice lathe, which is known in the art for contouring assembled chains, and then such links might be similarly frozen and contoured until the outer periphery assumes a desired appearance. Other supporting apparatus might be used to produce a similar desired effect.

Figure 14N:
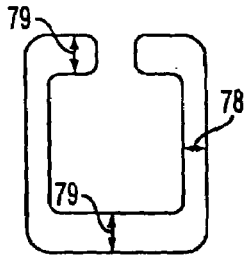
FIGS. 14*a* through 14*bp* illustrate a variety of individual link configurations capable of being produced in accordance with the method of the present invention.
Figure 14O:
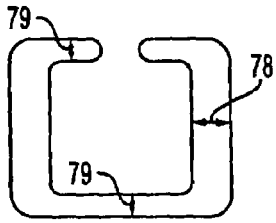
Figure 14A:
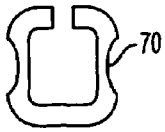
Figure 14B:
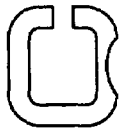
Figure 14C:
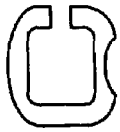
Figure 14D:
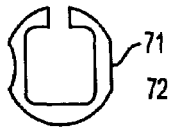
Figure 14E:
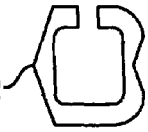
Figure 14F:
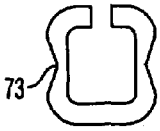
Figure 14G:
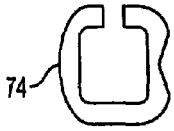
Figure 14H:
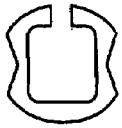
Figure 14I:
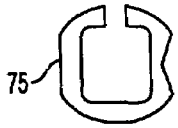
Figure 14J:
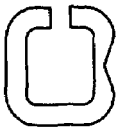
Figure 14K:
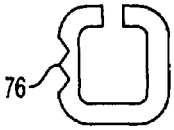
Figure 14L:
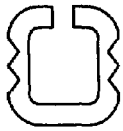
Figure 14M:
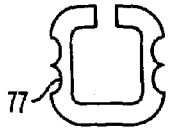
Figure 14A:
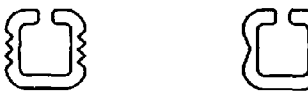
Figure 14A:
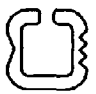
Figure 14A:
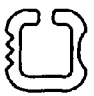
Figure 14A:
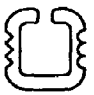
Figure 14A:
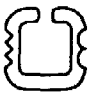
Figure 14A:
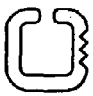
Figure 14A:
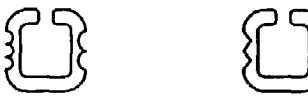
Figure 14A:
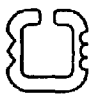
Figure 14A:
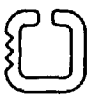
Figure 14A:
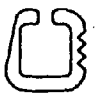
Figure 14A:
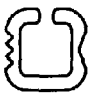
Figure 14A:
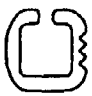
Figure 14A:
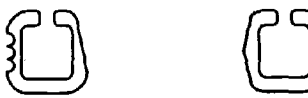
Figure 14B:
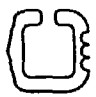
Figure 14B:
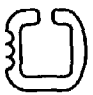
Figure 14B:
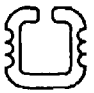
Figure 14B:
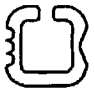
Figure 14B:
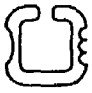
Figure 14B:
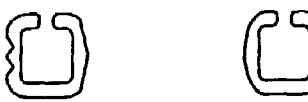
Figure 14B:
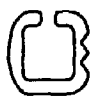
Figure 14B:
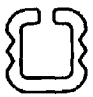
Figure 14B:
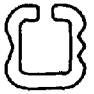
Figure 14B:
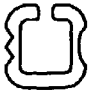
Figure 14B:
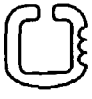

FIGS. 14*a*–14*bp* illustrate a variety of individual link configurations capable of being produced in accordance with any of the methods of the present invention, each link having a uniquely and fashionably contoured outer periphery, with a non-contoured inner periphery, and a non-uniform thickness along at least one portion of the link as compared with other portions of the link. Such figures are only representative, and are by no means exhaustive of the possible contouring variations capable of being produced using the method of the present invention. Many of the links illustrated in FIGS. 14*a*–14*bp* have unique outer peripheral surface features. For example, some links have at least one concave surface 70 on at least one outer wall, while others have at least one flat surface 71. Other features present on at least one outer wall include at least one laterally tapering wall 72 toward one end of the outer periphery, an indent 73, a convex surface 74, an outer peripheral surface 75 that is parallel in profile to the adjacent inner peripheral surface, a protrusion 76 and a plurality of "C"-shaped indentations. Other features not specifically detailed above will also be apparent with reference to such figures. The outer peripheries can also be contoured so that the links appear symmetrical about the vertical axis as shown in FIG. 14*a*, or non-symmetrical about any axis as shown in FIG. 14*d*. Of course, the contouring possibilities are limitless. However, in each case, only the outer periphery is contoured without affecting the inner periphery. Another feature of all links shown in FIGS. 14*a* through 14*bp* is that the thickness of each link is not uniform in at least one portion of the link. FIGS. 14*n* and 14*o* in particular illustrate a simple rectangular link where the outer periphery has been contoured so that the thickness of the vertically extending portions 78 is different from the horizontally extending portions 79, while the profile of the inner periphery remains unchanged. Of course, while FIGS. 14*n* and 14*o* illustrate a symmetric outer peripheral contouring resulting in a non-uniform thickness throughout the link, such contouring could also be non-symmetric as shown in many of the links illustrated in FIGS. 14*a* through 14*bp*. Irrespective of the symmetrical nature of the outer peripheral contouring, the thickness along at least one portion of the perimeter of all of the links illustrated in FIGS. 14*a* through 14*bp* is not uniform, whereas a prior art link of FIG. 2, which would be assembled into a rope chain as is, i.e., without a contoured outer periphery, would have a uniform thickness 18 throughout.

Figure 15:
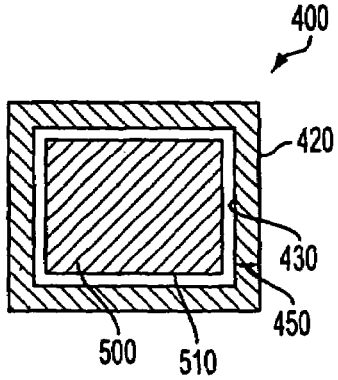
FIG. 15 is an edge view of a link having continuous inner and outer peripheries arranged on a mandril.

FIG. 15 illustrates an edge view of a link 400 arranged on a mandril 500, where said link 400 has a continuous outer periphery 420 and a continuous inner periphery 430, with a thickness 450 defined therebetween. Link 400 is not initially capable of being intertwined with other links to form a rope chain as is known in the art, since such link has continuous inner and outer peripheries with no gap defined therein. However, in accordance with the method of the present invention and with particular reference to FIG. 16, a gap 440 may be formed in the link 400, for enabling said link 400 to intertwine with other links to form a rope chain, as part of the contouring step. In other words, a gap 440 may be contoured into or through the links using contouring apparatus 600 having a gap-creating contouring bit 610, while the remaining outer periphery of the links may be fashionably contoured as described in any of the above described methods. The contouring of the outer periphery of the links and/or the creation of a gap in a link having continuous inner and outer peripheries can occur simultaneously, or at different times, depending on the construction of the contouring apparatus acting upon a link-loaded mandril.

Figure 16:
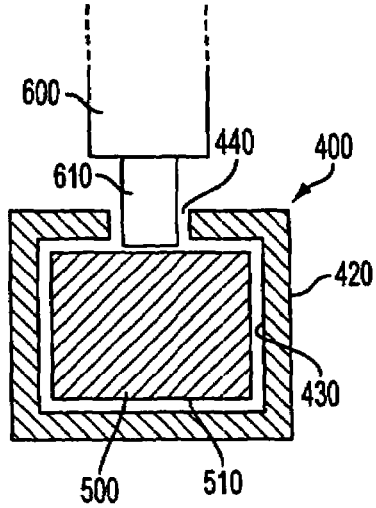
FIG. 16 is an edge view of a link-loaded mandril passing through contouring apparatus.

FIG. 16 illustrates the creation of a gap region 440 in a link 400 or a plurality of links loaded or arranged on a mandril as previously described. The mandril 500 of FIGS. 15 and 16 is not equipped with a protrusion akin to the protrusion 130 of mandril 100 described previously, for the obvious reason that the links 400 are not initially provided with a gap to accommodate such a mandril protrusion. Even though the links 400 are not initially created or provided with a gap, and the mandril 500 is not provided with a gap-extensive protrusion member, the links remain supported on the mandril 500 by the interaction between the outer periphery 510 of the mandril 500 and the inner periphery of the link or links 400, both before and after a gap is fashioned or contoured into the links. For example, the rectangular configuration of both the outer periphery of the mandril and the inner periphery of the link and the slidable clearance present therebetween when the links are arranged on the mandril, prevent the links from rotating or rocking or wobbling about the mandril, thereby assuring consistent contouring of the outer peripheries of the links. Other mandril and link shapes and cross sections will also be operative, so long as the mandril prevents the links from rotating about the mandril or otherwise jeopardizing the consistent contouring of the outer periphery of the links during passage through contouring apparatus.

Figure 17:
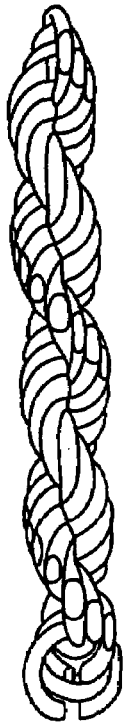
FIG. 17 is a representation of a rope chain created from links formed in accordance with method of the present invention.

Once the outer peripheries of the links have been contoured, which might or might not include the creation of a gap depending on whether or not the links have been provided with a gap, the links are removed from the mandril and assembled into rope chains as illustrated in FIG. 17. While the method of the present invention is particularly applicable to a method of forming links for use in rope chains, it will be understood that such links may be used for other purposes. For example, fashionably contoured links might be used to create other items of jewelry, such as other jewelry chains, earrings, bracelets, or the like, or such contoured links might be used in other areas of commerce not necessarily related to jewelry items.

Figure 18:
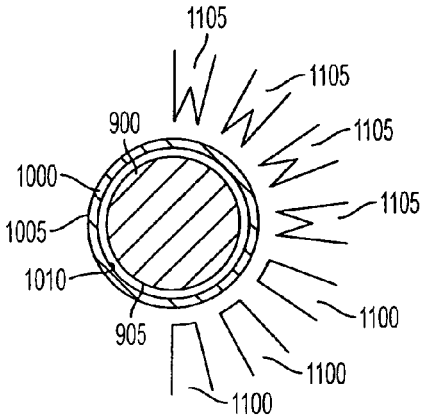
FIG. 18 is an edge view of a wire wrapped around a mandril and being contoured simultaneously by a plurality of contouring means.

FIG. 18 illustrates a method of contouring and forming jewelry chain links according to yet another embodiment of the present invention. A mandril 900 having an outer periphery 905 is provided in this embodiment without any recessed portions. An uncontoured chain link or a plurality of chain links (see, for example, FIGS. 8 and 9) or a wire (see, for example, FIG. 3) 1000 is suitably arranged thereon. For purposes of explanation, reference number 1000 will represent a link (or a plurality of links) as discussed above, it being understood that the method illustrated in FIG. 18 could also be applied to a wire as discussed in connection with FIG. 3 and as discussed in connection with the previous embodiment. Such link and/or wire may be hollow or solid as is known in the art, and may have any cross sectional configuration as is known in the art. If a wire, than such cross section is preferably round.

The method of contouring illustrated in FIG. 18 is similar to that shown in FIG. 3. However, in FIG. 18, a plurality of contouring means, or blades as the case may be, is simultaneously drawn across the outer periphery 1005 of link 1000 to simultaneously create a plurality of contours. Alternatively, the mandril 900 may be drawn across the contouring means as the case may be. Such contouring means may comprise, but not be limited to, single edge deformers 1100 or multiple edge deformers 1105 as the case may be, with such deformers being flat edges that actually cut into the outer periphery 1005 of the link or that merely flatten the outer periphery 1005 without breaking through the outer surface thereof. Flattening of the outer periphery is preferable if the links are hollow. Having multiple edge deformers 1105 maximizes the numbers of facets or contours applied to the outer periphery of the link 1000 in a single pass of the contouring means.

The arrangement of deforming means around the mandril 900 and the manner in which such deforming means is applied to the outer periphery of the link will determine the final appearance of the chain link and the final appearance of the assembled chain. For instance, while FIG. 18 illustrates a plurality of multiple edge deformers 1105 and a plurality of single edge deformers 1100, such contouring means may include only single edge deformers 1100 or only multiple edge deformers 1105, or a combination of both as the case may be. The contouring means also does not have to comprise planar edges, but can also comprise other shapes such as concave curved edges, convex curved edges or a combination of the two. Other contouring means configurations are contemplated.

Figure 19:
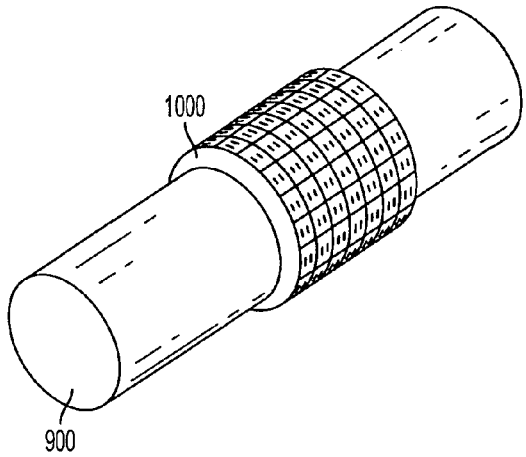
FIG. 19 is a diagrammatic view of a contoured wire wrapped around a mandril.

The deforming means may be arranged around the mandril 900 so that a single pass of the mandril with respect to the deforming means may only be required to achieve the desired contour configuration on the wrapped wire and/or chain link, or multiple passes may be required. For instance, if it is desired to create a link having twelve facets, then it may be possible to create all twelve facets at the same time if the contouring means can be arranged in a symmetric fashion around the mandril and the mandril is adequately supported. However, it may be necessary to contour half the wire and/or link in one contouring pass, then rotate the mandril and contour the other half to get adequate support of the mandril. Thus, to achieve a link having twelve facets, for example, it may be necessary to produce six facets along the first contouring pass, rotate the mandril, and then produce another six facets during the second contouring pass. Thus, once faceted, the wrapped wire 1000 situated on the mandril 900 may appear as shown in FIG. 19.

Figure 20:
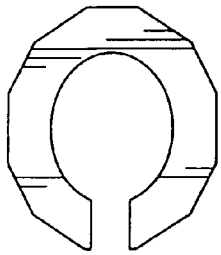
FIGS. 20–22 illustrate chain links having 12, 16 and 24 facets respectively.
Figure 21:
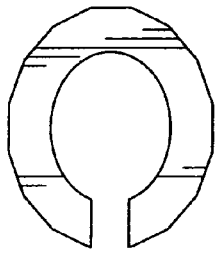
Figure 22:
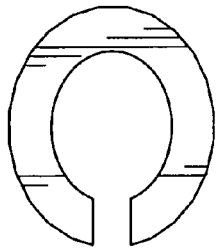

After the wire 1000 has been faceted, the wire 1000 may be segmented into chain links having a gap for intertwining with other links to form a jewelry chain or a jewelry rope chain as the case may be. A variety of faceting arrangements are possible. For example, the resultant link may have X number of facets, where X is preferably greater than 8 but less than 64. A twelve-sided faceted link is illustrated in FIG. 20, while sixteen- and twenty-four-sided faceted links are illustrated in FIGS. 21 and 22 respectively. Other faceting arrangements are possible. It is preferable that the number of facets does not become too numerous, since the outer periphery of the link will appear to resemble a smooth, annular configuration with an extensive number of facets.

The contouring embodiment illustrated in FIGS. 18–22, as noted above, can also be applied to a plurality of chain links arranged on a mandril. For instance, while FIG. 3 illustrates the use of a single contouring apparatus 90 and while FIGS. 11–13 illustrates the passage of a link-laden mandril 300 by contouring apparatus 200, 250, a contouring apparatus having multiple contouring edges or means may act in concert across a link-laden mandril to facet or otherwise apply multiple contours in a single contouring pass.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention.

We claim:

1. A method of producing chain links suitable for use in making jewelry chains comprising the steps of:

a) providing a mandrel having an outer periphery, b) wrapping a piece of fixed length wire from a fixed length coil around said mandrel, said wrapped wire having an inner periphery disposed adjacent said outer periphery of said mandrel, and an outer periphery, and c) contouring the outer periphery of said wrapped wire and separating said wrapped wire into individual chain links suitable for assembly into a jewelry chain, each of said chain links having an outer periphery, d) wherein said contouring comprises the creation of X number of facets disposed around said outer periphery of said chain links, X having a value that is greater than 8;

(e) wherein said wrapping comprises that each winding of the wrapped wire abuts directly to at least another winding of the wrapped wire.

2. A method in accordance with claim 1, wherein said contouring occurs by multiple passes of a contouring apparatus, each pass resulting in the creation of at least two facets.

3. A method in accordance with claim 1, wherein said contouring further comprises the application of a plurality of deformers against the outer periphery of said wrapped wire.

4. A method in accordance with claim 3, wherein said plurality of deformers are single edge deformers.

5. A method in accordance with claim 3, wherein said plurality of deformers are multiple edge deformers.

6. A method in accordance with claim 3, wherein said plurality of deformers further comprise a combination of single edge and multiple deformers.

7. A method in accordance with claim 3, wherein at least one of said plurality of deformers has a straight edge.

8. A method in accordance with claim 3, wherein at least one of said plurality of deformers has a curved edge.

9. A method in accordance with claim 1, wherein said wrapped wire is hollow.

10. A method in accordance with claim 1, wherein said wrapped wire is solid.

* * * * *